US010705440B2

(12) United States Patent
Ueno et al.

(10) Patent No.: US 10,705,440 B2
(45) Date of Patent: Jul. 7, 2020

(54) ELECTROPHOTOGRAPHIC PHOTOSENSITIVE MEMBER, PROCESS CARTRIDGE AND ELECTROPHOTOGRAPHIC APPARATUS

(71) Applicant: CANON KABUSHIKI KAISHA, Tokyo (JP)

(72) Inventors: Takanori Ueno, Nagareyama (JP); Kumiko Takizawa, Saitama (JP); Ikuyo Kuroiwa, Tokyo (JP); Tsuyoshi Shimada, Kashiwa (JP); Wataru Kitamura, Abiko (JP); Eileen Takeuchi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/426,069

(22) Filed: May 30, 2019

(65) Prior Publication Data

US 2019/0369513 A1 Dec. 5, 2019

(30) Foreign Application Priority Data

Jun. 5, 2018 (JP) ..... 2018-107548

(51) Int. Cl.
*G03G 5/14* (2006.01)
*G03G 5/10* (2006.01)

(52) U.S. Cl.
CPC ..... *G03G 5/14* (2013.01); *G03G 5/10* (2013.01)

(58) Field of Classification Search
CPC ..... G03G 5/14; G03G 5/10
See application file for complete search history.

(56) References Cited

U.S. PATENT DOCUMENTS

| | | | |
|---|---|---|---|
| 5,198,685 | A | 3/1993 | Kitani et al. |
| 5,876,890 | A | 3/1999 | Kitamura et al. |
| 5,912,098 | A | 6/1999 | Tanaka et al. |
| 6,405,005 | B1 | 6/2002 | Kitamura et al. |
| 6,408,152 | B1 | 6/2002 | Kitamura et al. |
| 7,645,547 | B2 | 1/2010 | Okuda et al. |
| 7,655,370 | B2 | 2/2010 | Kitamura et al. |
| 7,813,675 | B2 | 10/2010 | Tanabe et al. |
| 9,766,561 | B2 | 9/2017 | Takahashi et al. |
| 9,791,792 | B2 | 10/2017 | Miyauchi et al. |
| 9,811,012 | B2 | 11/2017 | Murakami et al. |
| 9,817,324 | B2 | 11/2017 | Kitamura et al. |
| 9,971,258 | B2 | 5/2018 | Kitamura et al. |
| 9,983,490 | B2 | 5/2018 | Shimada et al. |
| 10,042,273 | B2 | 8/2018 | Takahashi et al. |
| 10,241,429 | B2 | 3/2019 | Shimada et al. |

(Continued)

FOREIGN PATENT DOCUMENTS

JP 2002-311625 A 10/2002

*Primary Examiner* — Susan S Lee
(74) *Attorney, Agent, or Firm* — Venable LLP

(57) ABSTRACT

Provided is an electrophotographic photosensitive member that can suppress the generation of both an interference fringe and a streaky uneven part in a circumferential direction on an image. The generation of the interference fringe and the generation of the streaky uneven part in the circumferential direction on the image are suppressed by defining a length of a line-shaped groove of a support in a circumferential direction, and defining roughness parameters of a support in an axial direction.

6 Claims, 3 Drawing Sheets

(56) References Cited

U.S. PATENT DOCUMENTS

| | | | | |
|---|---|---|---|---|
| 10,338,486 | B2 | 6/2019 | Abe et al. | |
| 2010/0300604 | A1* | 12/2010 | Goss | B41J 2/0057 156/154 |
| 2014/0004450 | A1 | 1/2014 | Tokimitsu et al. | |
| 2018/0299822 | A1 | 10/2018 | Kuroiwa et al. | |
| 2018/0314188 | A1 | 11/2018 | Takeuchi et al. | |
| 2019/0072865 | A1 | 3/2019 | Ohira et al. | |
| 2019/0094735 | A1 | 3/2019 | Kuroiwa et al. | |

* cited by examiner

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

Field of the Invention

The present disclosure relates to an electrophotographic photosensitive member, and a process cartridge and an electrophotographic apparatus that include the electrophotographic photosensitive member.

Description of the Related Art

An electrophotographic apparatus using an electrophotographic scheme is widely and generally utilized as a copying machine, a facsimile apparatus, a printer and the like. In such an electrophotographic process, a surface of an electrophotographic photosensitive member provided with a photoconductive layer is uniformly charged, and is exposed with a laser, an LED or the like according to image information to form an electrostatic latent image on the surface of the electrophotographic photosensitive member. Subsequently, depending on the formed electrostatic latent image, a toner is developed on the surface of the electrophotographic photosensitive member to form a toner image, and this toner image is transferred onto a recording material such as paper to form an image. Then, the remaining toner on the electrophotographic photosensitive member that has not been transferred is removed by a cleaner for the electrophotographic photosensitive member, and the following image forming process is repeatedly performed.

As an electrophotographic photosensitive member that can be conveniently used in such an electrophotographic apparatus, an organic electrophotographic photosensitive member (OPC) using an organic photoconductive substance has been developed and become widespread.

As the development of electrophotographic apparatuses has advanced, improvement in image quality has been required, and thus, uneven shades are sometimes considered to be a problem, for example, due to an interference fringe on a halftone image resulting from interference with an incident light, and a streaky uneven part involved in the machining feed pitch of the support, both of which were not formerly problematic.

In order to solve such a problem, Japanese Patent Application Laid-Open No. 2002-311625 discloses a technique for reducing an interference fringe by roughening a surface of a substrate.

SUMMARY OF THE INVENTION

Conventionally, a surface of the support has been roughened to address an interference fringe on an image resulting from interference with light reflected from the support.

As a method for roughening a surface of the support, methods such as cutting and grinding are preferably used in view of control of a numerical value of the surface roughness of the support, and machining of the support.

However, when a surface of the support is roughened by a method such as cutting and grinding, a line-shaped groove extending in a circumferential direction of the support is formed. The line-shaped groove is formed depending on the machining feed pitch of the support, and in some cases, a streaky uneven part resulting from the line-shaped groove is formed on the image.

Therefore, it is an object of the present disclosure to provide an electrophotographic photosensitive member that can suppress the generation of both an interference fringe and a streaky uneven part.

The above object is accomplished by the present disclosure described below.

In other words, an electrophotographic photosensitive member according to the present disclosure includes a cylindrical support, an undercoat layer and a photosensitive layer in this order, wherein a surface of the support includes a line-shaped groove in a circumferential direction of the support, and when a represents a length of the line-shaped groove in the circumferential direction, with regard to 90% or more of the line-shaped groove based on the entirety thereof, the length a satisfies $$50\ \mu m \leq a \leq 500\ \mu m,$$

a ten-point average roughness Rzjis, an average length Rsm of a roughness profile element, and a skewness (degree of asymmetry) Rsk according to JIS B 0601:2001 obtained from a roughness profile in an axial direction of the surface of the support satisfy $$0.7\ \mu m \leq Rzjis$$

$$Rsm \leq 50\ \mu m, \text{ and}$$

$$-4.0 \leq Rsk \leq -0.2,$$

respectively.

According to the present disclosure, it is possible to provide an electrophotographic photosensitive member that can suppress the generation of both an interference fringe and a streaky uneven part.

Further features of the present disclosure will become apparent from the following description of exemplary embodiments with reference to the attached drawings.

DESCRIPTION OF THE EMBODIMENTS

Figure 1:
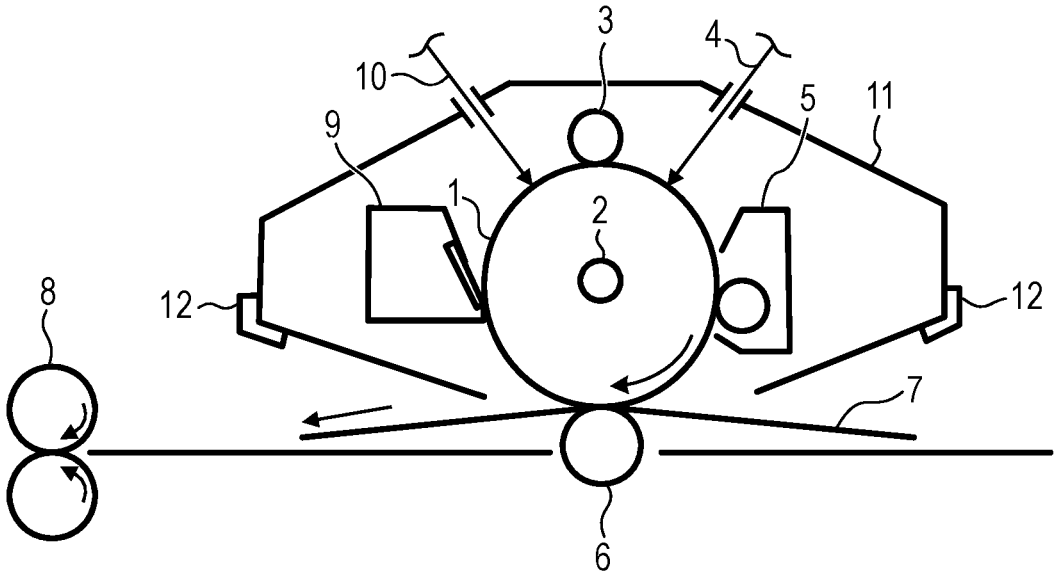
FIG. 1 illustrates one example of an electrophotographic apparatus including a process cartridge including an electrophotographic photosensitive member of the present disclosure.

Preferred embodiments of the present disclosure will now be described in detail in accordance with the accompanying drawings.

Conventionally, the surface roughness of a support has been defined in order to eliminate an interference fringe and a streaky uneven part on an image; however, it has been found that, due to improvement in the image quality, conventional definitions of roughness may be not enough to suppress an interference fringe and a streaky uneven part on an image.

In order to solve the technical problem experienced in the above conventional techniques, the present inventors have studied adjustment of a length of the line-shaped groove in a circumferential direction of the support and also adjustment of roughness parameters in an axial direction of the support.

As a result of the above study, it has been found that, when a represents a length of a line-shaped groove in a circumferential direction of the support, with regard to 90% or more of the line-shaped groove based on the entirety thereof, the length a satisfies 50 μm≤a≤500 nm, and a ten-point average roughness Rzjis, an average length Rsm of a roughness profile element, and a skewness Rsk according to JIS B 0601:2001 obtained from a roughness profile in an axial direction of the surface of the support satisfy 0.7 μm≤Rzjis, Rsm≤50 μm, and −4.0≤Rsk≤−0.2, respectively, and as a result of this, the technical problem experienced in conventional techniques can be solved.

According to the present disclosure, a length a of a line-shaped groove means a length of a groove resulting from the roughening of the support in a circumferential direction of the support. Rzjis, Rsm and Rsk are represented by the following formulas, respectively.

Ten-point average roughness $$Rzjis = \frac{1}{5}\sum_{i=1}^{5}(Zpi + Zvj)$$

Zpi=heights from the highest profile peak height to the fifth highest profile peak height in a profile Zvj=heights from the lowest profile valley depth to the fifth lowest profile valley depth in a profile An average length of a roughness profile element $$Rsm = \frac{1}{m}\sum_{i=1}^{m} Xsi$$

Xsi=a length of a profile element m=the number of a profile element

Degree of asymmetry (a measure for the asymmetry of probability density function in a direction of height)

$$Rsk = \frac{1}{Rq^3}\left(\frac{1}{l_r}\int_0^{lr} Z^3(x)dx\right)$$

Rq=a root mean square height of a roughness profile $l_r$=a length in a direction of X axis Z(x)=a height at a position x in a direction of Z axis The reason why the problem can be solved by the above technique will be described below.

Shorter length of the line-shaped groove in a circumferential direction leads to lower visibility on an image, and therefore has advantageous influence on the suppression of an interference fringe and a streaky uneven part. As Rz for representing depth of the line-shaped groove becomes higher, scattering of light reflected by the support is facilitated, and as a result of this, the suppression of an interference fringe is facilitated. It is considered that, as Rsm for representing pitch of a line-shaped groove of the support becomes lower, visibility on an image becomes lower, and as a result of this, the suppression of an interference fringe is facilitated.

However, in some cases, a streaky uneven part cannot be suppressed by merely adjusting the above-described parameters. As a result of the studies, it has been found that a streaky uneven part can be suppressed by adjusting the skewness (Rsk) in addition to the above-described roughness parameters.

Rsk is a roughness parameter for representing a degree of asymmetry, and when Rsk is >0, the support has a large kurtosis, and when Rsk is <0, the support has a shape having a small kurtosis.

It is considered that interference due to reflected light from a groove formed on the support becomes weaker by adjusting the value of Rsk to be −4.0≤Rsk≤−0.2, and as a result of this, a streaky uneven part tends not to occur on the image.

As described above, the configurations influence each other in a synergistic manner, and as a result of this, an effect of the present disclosure can be accomplished.

In order to suppress the generation of the streaky uneven part, the skewness (Rsk) is more preferably in the range of −1.2≤Rsk≤−0.2.

In order to suppress the interference fringe, the above parameters are more preferably in the range of 50 μm≤a≤400 μm, 1.0 μm≤Rzjis≤1.5 μm, and 30 μm≤Rsm≤40 μm.

[Electrophotographic Photosensitive Member]

An electrophotographic photosensitive member of the present disclosure includes a support, an undercoat layer and a photosensitive layer in this order.

Examples of a method for producing an electrophotographic photosensitive member of the present disclosure include a method of preparing a coating solution of each of the layers described below, coating the coating solution so as to achieve a desired order of layers, and drying the coating solution. In this case, examples of a method for coating the coating solution include dip coating, spray coating, ink jet coating, roll coating, die coating, blade coating, curtain coating, wire bar coating and ring coating. Among these, dip coating is preferable in view of efficiency and productivity.

Each of the layers will be described below.

<Support>

In the present disclosure, the electrophotographic photosensitive member includes a support. In the present disclosure, the support is preferably an electroconductive support having electroconductivity. As the support, a cylindrical support is used. In order to adjust roughness of a surface of the support, the surface of the support can be subjected to cutting, grinding, blasting and the like.

As a material of the support, a metal, a resin, glass and the like are preferable. Examples of the metal include aluminum, iron, nickel, copper, gold, stainless steel, and an alloy of these. Among these, a support made of aluminum is preferable.

The resin and glass can be provided with electroconductivity by treatment such as mixing of an electroconductive material into the resin and glass, or covering the resin and glass by an electroconductive material.

<Electroconductive Layer>

In the present disclosure, an electroconductive layer can be provided on the support. By providing the electroconductive layer, defects or depressions and projections on the surface of the support can be masked, or reflection of light on the surface of the support can be controlled. The electroconductive layer preferably contains an electroconductive particle and a resin.

Examples of a material of the electroconductive particle include a metal oxide, a metal and carbon black.

Examples of the metal oxide include zinc oxide, aluminum oxide, indium oxide, silicon oxide, zirconium oxide, tin oxide, titanium oxide, magnesium oxide, antimony oxide and bismuth oxide. Examples of the metal include aluminum, nickel, iron, nichrome, copper, zinc and silver.

Among these, a metal oxide is preferably used as an electroconductive particle, and in particular, titanium oxide, tin oxide and zinc oxide are more preferably used.

When a metal oxide is used as an electroconductive particle, a surface of the metal oxide can be treated, for example, with a silane coupling agent, or the metal oxide can be doped, for example, with elementary phosphorus, elementary aluminum or oxides of these.

An electroconductive particle can be in a stacked configuration including a core particle, and a covering layer covering the core particle. Examples of the core particle include titanium oxide, barium sulfate and zinc oxide. Examples of the covering layer include a metal oxide such as tin oxide.

When a metal oxide is used as an electroconductive particle, the volume average particle size of the metal oxide is preferably 1 nm or more and 500 nm or less, and more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin and an alkyd resin.

The electroconductive layer can further contain a masking agent such as silicone oil, a resin particle and titanium oxide.

The average film thickness of the electroconductive layer is preferably 1 μm or more and 50 μm or less, and particularly preferably 3 μm or more and 40 μm or less.

The electroconductive layer can be formed by preparing a coating solution intended for an electroconductive layer and containing each of the materials described above and a solvent, forming a coat from this coating solution, and drying the coat. Examples of the solvent for use in the coating solution include an alcohol based solvent, a sulfoxide based solvent, a ketone based solvent, an ether based solvent, an ester based solvent and an aromatic hydrocarbon based solvent. Examples of a method for dispersing an electroconductive particle in a coating solution intended for an electroconductive layer include a method using a paint shaker, a sand mill, a ball mill, or a liquid collision type high speed dispersing machine.

<Undercoat Layer>

In the present disclosure, an undercoat layer is provided on the support or the electroconductive layer. By providing the undercoat layer, the function of adhesion between the layers is increased to enable a charge injection prevention function to be imparted.

The undercoat layer preferably contains a resin. The undercoat layer can also be formed as a curable film by polymerizing compositions containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide-imide resin and a cellulose resin.

Examples of the polymerizable functional group possessed by the monomer having the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group and a carbon-carbon double bond group.

The undercoat layer can further contain an electron transport substance, a metal oxide, a metal, an electroconductive macromolecule and the like in order to improve the electrical properties. Among these, an electron transport substance and a metal oxide is preferably used.

Examples of the electron transport substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound and a boron containing compound. As the electron transport substance, an electron transport substance having a polymerizable functional group can be used to perform the copolymerization of the electron transport substance with the above-described monomer having a polymerizable functional group, in order to form an undercoat layer as a curable film.

Examples of the metal oxide include indium tin oxide, tin oxide, indium oxide, titanium oxide, zinc oxide, aluminum oxide and silicon dioxide. Examples of the metal include gold, silver and aluminum.

The undercoat layer can further contain an additive.

The average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating solution intended for an undercoat layer and containing each of the materials described above and a solvent, forming a coat from this coating solution, and drying and/or curing the coat. Examples of the solvent for use in the coating solution include an alcohol based solvent, a ketone based solvent, an ether based solvent, an ester based solvent and an aromatic hydrocarbon based solvent.

<Photosensitive Layer>

The photosensitive layers of the electrophotographic photosensitive member are mainly classified into (1) stacked photosensitive layer and (2) monolayer type photosensitive layer. (1) The stacked photosensitive layer includes a charge generating layer containing a charge generating substance, and a charge transport layer containing a charge transport substance. (2) The monolayer type photosensitive layer includes a photosensitive layer containing both of a charge generating substance and a charge transport substance.

(1) Stacked Photosensitive Layer

The stacked photosensitive layer includes a charge generating layer and a charge transport layer.

(1-1) Charge Generating Layer

The charge generating layer preferably contains a charge generating substance and a resin.

Examples of the charge generating substance include an azo pigment, a perylene pigment, a polycyclic quinone pigment, an indigo pigment and a phthalocyanine pigment. Among these, an azo pigment and a phthalocyanine pigment are preferable. Among the phthalocyanine pigments, an oxytitaniumphthalocyanine pigment, a chlorogallium phthalocyanine pigment and a hydroxygalliumphthalocyanine pigment are preferable.

The content of the charge generating substance in the charge generating layer is preferably 40% by mass or more and 85% by mass or less, and more preferably 60% by mass or more and 80% by mass or less, based on the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin and a polyvinyl chloride resin. Among these, a polyvinyl butyral resin is more preferable.

The charge generating layer can further contain an additive such as an antioxidant and an ultraviolet absorber. Specific examples of the additive include a hindered phenol compound, a hindered amine compound, a sulfur compound, a phosphorus compound and a benzophenone compound.

The average film thickness of the charge generating layer is preferably 0.1 μm or more and 1 μm or less, and more preferably 0.15 μm or more and 0.4 μm or less.

The charge generating layer can be formed by preparing a coating solution intended for a charge generating layer and containing each of the materials described above and a solvent, forming a coat from this coating solution, and drying the coat. Examples of the solvent for use in the coating solution include an alcohol based solvent, a sulfoxide based solvent, a ketone based solvent, an ether based solvent, an ester based solvent and an aromatic hydrocarbon based solvent.

(1-2) Charge Transport Layer

The charge transport layer preferably contains a charge transport substance and a resin.

Examples of the charge transport substance include a polycyclic aromatic compound, a heterocyclic compound, a hydrazone compound, a styryl compound, an enamine compound, a benzidine compound, a triarylamine compound, and a resin having a group derived from these substances. Among these, a triarylamine compound and a benzidine compound are preferable.

The content of the charge transport substance in the charge transport layer is preferably 25% by mass or more and 70% by mass or less, and more preferably 30% by mass or more and 55% by mass or less, based on the total mass of the charge transport layer.

Examples of the resin include a polyester resin, a polycarbonate resin, an acrylic resin and a polystyrene resin. Among these, a polycarbonate resin and a polyester resin are preferable. As the polyester resin, a polyarylate resin is particularly preferable.

The content ratio (mass ratio) of the charge transport substance to the resin is preferably 4:10 to 20:10, and more preferably 5:10 to 12:10.

The charge transport layer can contain an additive such as an antioxidant, an ultraviolet absorber, a plasticizer, a leveling agent, a slipping agent and an abrasion resistance improver. Specific examples of the additive include a hindered phenol compound, a hindered amine compound, a sulfur compound, a phosphorus compound, a benzophenone compound, a siloxane modified resin, silicone oil, a fluorine resin particle, a polystyrene resin particle, a polyethylene resin particle, a silica particle, an alumina particle and a boron nitride particle.

The average film thickness of the charge transport layer is preferably 5 μm or more and 50 μm or less, more preferably 8 μm or more and 40 μm or less, and particularly preferably 10 μm or more and 30 μm or less.

The charge transport layer can be formed by preparing a coating solution intended for a charge transport layer and containing each of the materials above described and a solvent, forming a coat from this coating solution, and drying the coat. Examples of the solvent for use in the coating solution include an alcohol based solvent, a ketone based solvent, an ether based solvent, an ester based solvent and an aromatic hydrocarbon based solvent. Among these solvents, an ether based solvent or an aromatic hydrocarbon based solvent is preferable.

(2) Monolayer Type Photosensitive Layer

The monolayer type photosensitive layer can be formed by preparing a coating solution intended for a photosensitive layer and containing a charge generating substance, a charge transport substance, a resin and a solvent, forming a coat from this coating solution, and drying the coat. The charge generating substance, the charge transport substance and the resin are analogous to the charge transport substance and the resin in the examples shown in "(1) Stacked photosensitive layer" described above.

<Protection Layer>

In the present disclosure, a protection layer can be provided on the photosensitive layer. The provision of the protection layer can improve the durability.

The Protection layer preferably contains an electroconductive particle and/or a charge transport substance, and a resin.

Examples of the electroconductive particle include a particle of a metal oxide such as titanium oxide, zinc oxide, tin oxide and indium oxide.

Examples of the charge transport substance include a polycyclic aromatic compound, a heterocyclic compound, a hydrazone compound, a styryl compound, an enamine compound, a benzidine compound, a triarylamine compound, and a resin having a group derived from these substances. Among these, a triarylamine compound and a benzidine compound are preferable.

Examples of the resin include a polyester resin, an acrylic resin, a phenoxy resin, a polycarbonate resin, a polystyrene resin, a phenol resin, a melamine resin and an epoxy resin. Among these, a polycarbonate resin, a polyester resin and an acrylic resin are preferable.

The protection layer can also be formed as a curable film by polymerizing compositions containing a monomer having a polymerizable functional group. Examples of the reaction in this case include a thermal polymerization reaction, a photopolymerization reaction and a radiation polymerization reaction. Examples of the polymerizable functional group possessed by the monomer having the polymerizable functional group include an acryl group and a methacryl group. As the monomer having a polymerizable functional group, a material having the ability to transport charges can also be used.

The protection layer can contain an additive such as an antioxidant, an ultraviolet absorber, a plasticizer, a leveling agent, a slipping agent and an abrasion resistance improver. Specific examples of the additive include a hindered phenol compound, a hindered amine compound, a sulfur compound, a phosphorus compound, a benzophenone compound, a siloxane modified resin, silicone oil, a fluorine resin particle, a polystyrene resin particle, a polyethylene resin particle, a silica particle, an alumina particle and a boron nitride particle.

The average film thickness of the protection layer is preferably 0.5 μm or more and 10 μm or less, and more preferably 1 μm or more and 7 μm or less.

The protection layer can be formed by preparing a coating solution intended for a protection layer and containing each of the materials described above and a solvent, forming a coat from this coating solution, and drying and/or curing the coat. Examples of the solvent for use in the coating solution include an alcohol based solvent, a ketone based solvent, an ether based solvent, a sulfoxide based solvent, an ester based solvent and an aromatic hydrocarbon based solvent.

[Process Cartridge and Electrophotographic Apparatus]

A process cartridge of the present disclosure supports the electrophotographic photosensitive member described above and at least one unit selected from the group consisting of a charging unit, a developing unit, a transfer unit and a cleaning unit, and is detachably attachable to a body of an electrophotographic apparatus.

The electrophotographic apparatus of the present disclosure includes the electrophotographic photosensitive member described above, a charging unit, an exposure unit, a developing unit and a transfer unit. In addition, the electrophotographic apparatus of the present disclosure includes, as the charging units, a charging roller disposed so as to abut the electrophotographic photosensitive member, and a charging unit for charging the electrophotographic photosensitive member by applying direct current voltage only.

FIG. 1 illustrates one example of a schematic configuration with regard to an electrophotographic apparatus including a process cartridge including an electrophotographic photosensitive member.

Reference number 1 represents a cylindrical electrophotographic photosensitive member, which is rotated at a predetermined circumferential velocity around an axis 2 in an arrowed direction. A surface of the electrophotographic photosensitive member 1 is charged by a charging unit 3 so as to have a predetermined positive or negative electric potential. FIG. 1 illustrates a roller type charging scheme by a charging member of roller type; however, a charging scheme such as a corona type charging scheme, a proximity type charging scheme or an injection type charging scheme can also be employed. A surface of the charged electrophotographic photosensitive member 1 is irradiated with an exposure light 4 from an exposure unit (not illustrated) to form an electrostatic latent image according to image information of interest. The electrostatic latent image formed on the surface of the electrophotographic photosensitive member 1 is developed by a toner contained in a developing unit 5 to form a toner image on the surface of the electrophotographic photosensitive member 1. The toner image formed on the surface of the electrophotographic photosensitive member 1 is transferred onto a transfer material 7 by a transfer unit 6. The transfer material 7 onto which the toner image has been transferred is delivered to a fixing unit 8, subjected to fixing treatment of the toner image, and printed out of the electrophotographic apparatus. The electrophotographic apparatus can include a cleaning unit 9 in order to remove a deposit such as the toner remaining on the surface of the electrophotographic photosensitive member 1 after the transfer. The electrophotographic apparatus may not further include the cleaning unit, and, that is to say, a system without a cleaner, which removes the above deposit by a developing unit and the like can also be used. The electrophotographic apparatus can include a neutralization mechanism for subjecting the surface of the electrophotographic photosensitive member 1 to neutralization treatment by pre-exposure light 10 from a pre-exposure unit (not illustrated). A guiding unit 12 such as a rail can be provided in order to attach the process cartridge 11 of the present disclosure to the body of the electrophotographic apparatus, or to detach the process cartridge 11 from the body of the electrophotographic apparatus.

The electrophotographic photosensitive member of the present disclosure can be used in a laser beam printer, an LED printer, a copying machine, a facsimile machine, a combined machine of these, and the like.

EXAMPLES

The present disclosure will be described below in a more detailed way by Examples and Comparative Examples. The present disclosure is not limited by the following Examples in any way without departing from the spirit of the present disclosure. In the description of the following Examples, "part" is based on mass unless otherwise stated.

Example 1

[Processing of Support]

Figure 2:
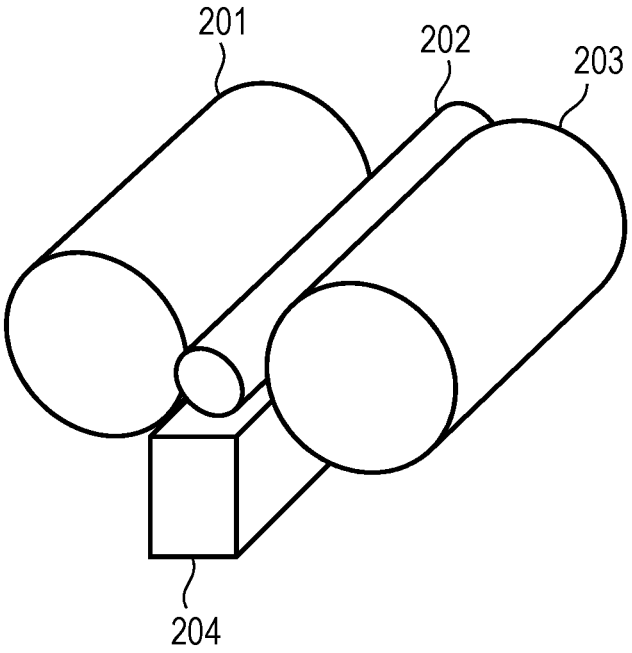
FIG. 2 illustrates one example of a centerless grinder for grinding a support of an electrophotographic photosensitive member of the present disclosure.

As a support, an aluminum blank tube having a length of 354 mm, a thickness of 1 mm and an outer diameter of 30 mm was provided. A surface of the provided aluminum blank tube was ground using a centerless grinder as illustrated in FIG. 2 under the following grinding conditions. In FIG. 2, reference number 201 represents a grindstone for grinding, reference number 202 represents a support, reference number 203 represents an adjustment grindstone, and reference number 204 represents a carrier.

"Grinding Conditions"

Grindstone for grinding: SiC #500

The number of revolutions for grinding: 1000 rpm

Rough grinding volume: 0.16 mm

Rough grinding feed rate: 1.0 m/min

Grinding scheme: through feed scheme

Next, in order to eliminate a projecting portion of the aluminum cylinder roughened by a centerless grinder to smoothen the aluminum cylinder, the ground support was subjected to blasting. By eliminating the projecting portion, the value of Rsk as a roughness parameter can be adjusted to become smaller. The blasting was performed under relatively mild conditions so as not to cause a large degree of change in the roughness parameters other than Rsk.

By means of a blasting machine (model: HD-10) manufactured by Fujiseiki Machine Works, Ltd., the blasting was performed at the injection pressure of 0.5 MPa using a melamine particle having a mean particle size of 100 rpm. The blasting time, the amount of a particle to be injected, and the distance between the nozzle and the aluminum cylinder were adjusted so as not to cause a large degree of change in the roughness parameters other than Rsk.

Immediately after the blasting as described above, the aluminum cylinder was temporarily immersed in an immersion bath filled with pure water, and pulled up from the immersion bath, and subjected to washing by showering with pure water before the aluminum cylinder became dry. Subsequently, hot water at 85° C. was dispensed from a dispensing nozzle to the internal surface of the aluminum cylinder so as to contact hot water with the internal surface, and subsequently, the outer surface was dried. Subsequently, the internal surface of the aluminum cylinder was dried by natural drying.

The aluminum cylinder subjected to the surface treatment as described above was used as a support of the electrophotographic photosensitive member.

The fabricated support was subjected to measurement of the surface roughness by a surface roughness measuring instrument (model: SE700) manufactured by Kosaka Laboratory Ltd. The measurement was performed under the conditions of the cutoff value set to be 0.8 mm, the measurement length set to be 4 mm, and the data interval set to be 1.6 μm. A ten-point average roughness Rzjis, an average length Rsm of the roughness profile element, and a skewness Rsk that are determined according to JIS B 0601:2001 were determined from the roughness profile of the measured support.

A surface of the support was subjected to picture-taking by a laser microscope (model: VKX-200) manufactured by Keyence Corporation to measure a length a of the groove in a circumferential direction of the support. Specifically, the picture-taking was performed by a magnification of 500 times with regard to three points in an axial direction of the support, and four points in a circumferential direction, resulting in a total of 12 points. The obtained image was converted to binary by an image analyzing software, and the lengths of all of the line-shaped grooves on the image were calculated. From the calculated length of the line-shaped groove, the range of the length a of 90% or more of the line-shaped groove based on the entirety thereof was calculated.

[Fabrication of Electrophotographic Photosensitive Member]

Figure 3:
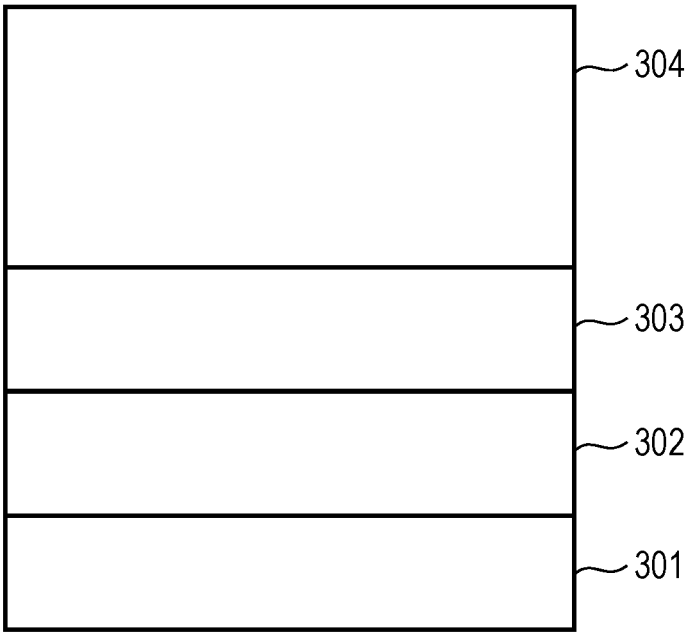
FIG. 3 illustrates one example of a layer configuration of an electrophotographic photosensitive member of the present disclosure.

Next, the support subjected to roughness measurement was used to fabricate an OPC photosensitive member in a layer configuration illustrated in FIG. 3. In FIG. 3, reference number 301 illustrates a support, reference number 302 illustrates an undercoat layer, reference number 303 illustrates a charge generating layer, and reference number 304 illustrates a charge transport layer. 10 parts of a copolymerized nylon (trade name: Amilan CM8000, manufactured by Toray Industries, Inc.), and 30 parts of a methoxymethylated nylon 6 resin (trade name: Trezine EF-30T, manufactured by Nagase ChemteX Corporation (formerly, Teikoku Kagaku Sangyo K.K.)) were dissolved in a mixed solvent of 400 parts of methanol and 200 parts of n-butanol to prepare a coating solution intended for an undercoat layer. With this coating solution intended for the undercoat layer, the above support was dip-coated to form a coat, and the obtained coat was dried at 100° C. for 30 minutes to form an undercoat layer having a film thickness of 0.70 μm.

Next, 4 parts of a hydroxygalliumphthalocyanine crystal (charge generating substance) as a crystal form having strong peaks at 7.4° and 28.1° of Bragg angle 20±0.2° in CuKα characteristic X-ray diffraction, and 0.04 parts of a compound represented by the following formula (A)

(A)

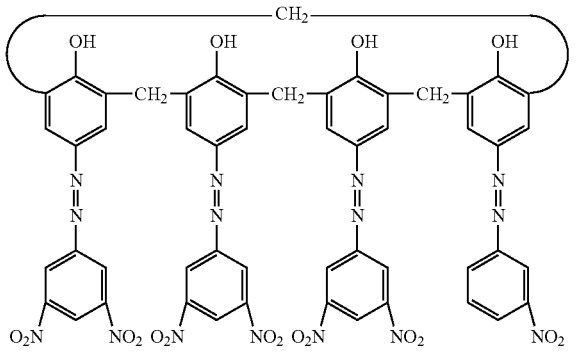

were added to a solution obtained by dissolving 2 parts of polyvinyl butyral (trade name: S-lec BX-1, manufactured by Sekisui Chemical Co., Ltd.) in 100 parts of cyclohexanone. These were placed into a sand mill with glass beads having a diameter of 1 mm, and subjected to dispersing treatment for 1 hour under an atmosphere at 23±3° C.

After the dispersing treatment, a coating solution intended for a charge generating layer was prepared by addition of 100 parts of ethyl acetate.

With this coating solution intended for the charge generating layer, the above undercoat layer was dip-coated to form a coat, and the obtained coat was dried at 90° C. for 10 minutes to form a charge generating layer having a film thickness of 0.19 μm.

Next, 60 parts of a compound represented by the following formula (B) (a charge transport substance), 30 parts of a compound represented by the following formula (C) (a charge transport substance), 10 parts of a compound represented by the following formula (D), (B)

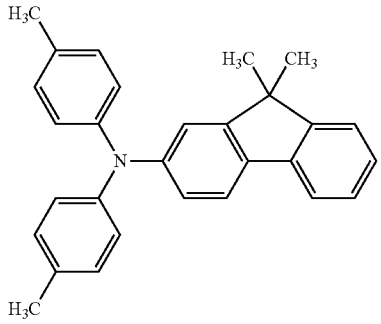

(C)

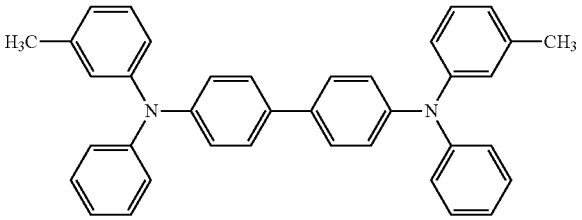

(D)

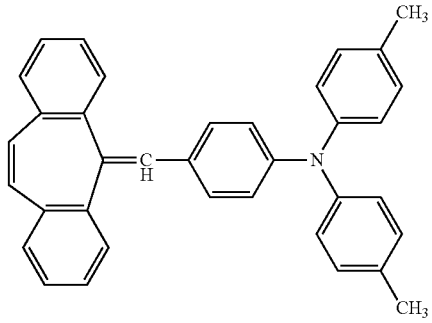

100 parts of a polycarbonate (trade name: Iupilon Z400, manufactured by Mitsubishi Engineering-Plastics Corporation, a bisphenol Z type polycarbonate), 0.2 parts of a polycarbonate (viscosity average molecular weight, Mv: 20000) having a structural unit represented by the following formula (E)

(E)

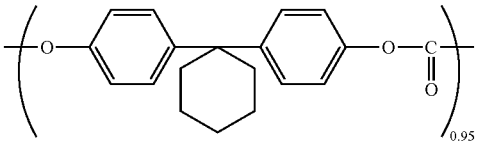

-continued

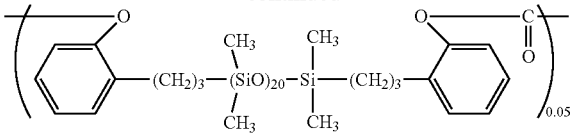

were dissolved in a mixed solvent of 260 parts of o-xylene, 240 parts of methyl benzoate and 260 parts of dimethoxymethane to prepare a coating solution intended for a charge transport layer.

With this coating solution intended for the charge transport layer, the above charge generating layer was dip-coated to form a coat, and the obtained coat was dried at 120° C. for 60 minutes to form a charge transport layer having a film thickness of 18 μm.

[Image Evaluation]

The fabricated photosensitive member was incorporated into a modified machine of a copying machine ImagePress C800 (2400 dpi) manufactured by Canon Inc. to evaluate the images. A halftone image was output with a dark part electric potential of 600 V, a bright part electric potential of 200 V and development bias of 350 V, and the halftone image was determined whether or not the halftone image has an interference fringe and a streaky uneven part.

An interference fringe and a streaky uneven part on the halftone image were assessed by the following criteria.

"Interference Fringe"

A: The halftone image has no interference fringe.

B: Although an interference fringe is slightly visible on a portion of the halftone image, there is no practical problem.

C: An interference fringe is slightly visible on the entirety of the halftone image.

"Streaky Uneven Part"

A: The halftone image has no streaky uneven part.

B: Although a streaky uneven part is slightly visible on a portion of the halftone image, there is no practical problem.

C: A streaky uneven part is slightly visible on the entirety of the halftone image.

In the present disclosure, when both of the interference fringe and the streaky uneven part are rated as B or higher, an effect of the present disclosure is determined to be present.

The obtained results of Example 1 are shown in Table 1.

Example 2

In Example 2, the fabrication of the support, the fabrication of the electrophotographic photosensitive member, and the image evaluation were performed in the same manner as in Example 1, except that the injection pressure for blasting the support was set at 0.6 MPa. The obtained results are shown in Table 1.

Example 3

In Example 3, the fabrication of the support, the fabrication of the electrophotographic photosensitive member, and the image evaluation were performed in the same manner as in Example 1, except that the injection pressure for blasting the support was set at 0.7 MPa. The obtained results are shown in Table 1.

Example 4

In Example 4, the fabrication of the support, the fabrication of the electrophotographic photosensitive member, and the image evaluation were performed in the same manner as in Example 1, except that the injection pressure for blasting the support was set at 0.8 MPa. The obtained results are shown in Table 1.

Example 5

In Example 5, the blasting, the fabrication of the electrophotographic photosensitive member, and the image evaluation were performed in the same manner as in Example 1, except that the support was subjected to centerless grinding at a feed rate of 1.1 m/min. The obtained results are shown in Table 1.

Example 6

In Example 6, the blasting, the fabrication of the electrophotographic photosensitive member, and the image evaluation were performed in the same manner as in Example 1, except that the support was subjected to centerless grinding at a feed rate of 1.1 m/min, and the injection pressure for blasting was set at 0.6 MPa. The obtained results are shown in Table 1.

Example 7

In Example 7, the blasting, the fabrication of the electrophotographic photosensitive member, and the image evaluation were performed in the same manner as in Example 1, except that the support was subjected to centerless grinding at a feed rate of 1.1 m/min, and the injection pressure for blasting was set at 0.8 MPa. The obtained results are shown in Table 1.

Example 8

In Example 8, the blasting, the fabrication of the electrophotographic photosensitive member, and the image evaluation were performed in the same manner as in Example 1, except that the support was subjected to centerless grinding at a feed rate of 1.2 m/min, and the injection pressure for blasting was set at 0.9 MPa. The obtained results are shown in Table 1.

Example 9

In Example 9, the blasting, the fabrication of the electrophotographic photosensitive member, and the image evaluation were performed in the same manner as in Example 1, except that the support was subjected to centerless grinding at a feed rate of 1.2 m/min, and the injection pressure for blasting was set at 1.0 MPa. The obtained results are shown in Table 1.

Comparative Example 1

In Comparative Example 1, the fabrication of the electrophotographic photosensitive member and the image evaluation were performed in the same manner as in Example 1, except that the support was subjected to centerless grinding at a feed rate of 1.2 m/min, and the blasting was not performed. The obtained results are shown in Table 1.

Comparative Example 2

In Comparative Example 2, the blasting, the fabrication of the electrophotographic photosensitive member, and the image evaluation were performed in the same manner as in Example 1, except that the support was subjected to centerless grinding at a feed rate of 1.2 m/min, and the injection pressure for blasting was set at 1.1 MPa. The obtained results are shown in Table 1.

Comparative Example 3

In Comparative Example 3, the blasting, the fabrication of the electrophotographic photosensitive member, and the image evaluation were performed in the same manner as in Example 1, except that the support was subjected to centerless grinding at a feed rate of 1.3 m/min, and the injection pressure for blasting was set at 1.1 MPa. The obtained results are shown in Table 1.

TABLE 1

| | Length a with regard to 90% or more of the line-shaped groove based on the entirety thereof [μm] | Rsm [μm] | Rzjis [μm] | Rsk | Interference fringe | Streaky uneven part |
|---|---|---|---|---|---|---|
| Example 1 | 50 ≤ a ≤ 400 | 30 | 1.5 | −0.2 | A | A |
| Example 2 | 50 ≤ a ≤ 400 | 34 | 1.3 | −0.4 | A | A |
| Example 3 | 50 ≤ a ≤ 400 | 38 | 1.2 | −0.8 | A | A |
| Example 4 | 50 ≤ a ≤ 400 | 40 | 1 | −1.2 | A | A |
| Example 5 | 50 ≤ a ≤ 400 | 42 | 0.9 | −0.2 | B | A |
| Example 6 | 50 ≤ a ≤ 500 | 43 | 0.8 | −0.5 | B | A |
| Example 7 | 50 ≤ a ≤ 500 | 45 | 0.8 | −1.2 | B | A |
| Example 8 | 50 ≤ a ≤ 500 | 45 | 0.7 | −2 | B | B |
| Example 9 | 50 ≤ a ≤ 500 | 50 | 0.7 | −4 | B | B |
| Comparative Example 1 | 50 ≤ a ≤ 500 | 46 | 0.7 | 0.1 | B | C |
| Comparative Example 2 | 50 ≤ a ≤ 500 | 49 | 0.7 | −5 | B | C |
| Comparative Example 3 | 50 ≤ a ≤ 600 | 60 | 0.6 | −5 | C | C |

In view of the results of Examples 1 to 9 and Comparative Examples 1 to 3, it was confirmed that an effect of the present disclosure was exhibited by adjusting the roughness parameters of the support to be in the range of 50 μm≤a≤500 μm, 0.7 μm≤Rzjis, Rsm≤50 μm, and −4.0≤Rsk≤−0.2.

In view of the results of Examples 5 to 9, it has been found that the suppression effect of the generation of a streaky uneven part on the image has a better value by adjusting the roughness of the support to be in the range of −1.2≤Rsk≤−0.2. With regard to the reason of this, it is considered that, in the range of −1.2≤Rsk≤−0.2, scattering of light reflected from the support was facilitated, and as a result of this, a streaky uneven part on the image was improved.

In view of the results of Examples 1 to 4, it was confirmed that, in the range of 50 μm≤a≤400 μm, 1.0 μm≤Rzjis≤1.5 μm, and 30 μm≤Rsm≤40 μm, the results with regard to the suppression of the generation of an interference fringe on the image became better. As the reason of this, it is considered that the length a of the line-shaped groove became shorter, and Rsm became lower, and as a result of this, the visibility on the image became lower, and in addition, scattering of light by the support became stronger due to the fact that Rzjis became higher, and as a result of this, the generation of an interference fringe on the image was improved.

It is considered that smaller Rsm is more advantageous for improvement with regard to the interference fringe; however, Rsm should be determined in view of the balance with productivity.

It is considered that higher Rz is more advantageous with regard to improvement in an interference fringe; however, Rz should be set in view of the film thickness of the primary layer and the like.

In the present Examples, the injection pressure of a particle to be blasted was changed; however, as long as Rsk can be adjusted, the amount of a particle to be injected, or the distance between the nozzle and the support may be adjusted.

In the present Examples, the surface roughness was adjusted by centerless grinding and blasting; however, any method can be employed as long as the method enables the adjustment of the surface roughness.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-107548, filed Jun. 5, 2018, which is hereby incorporated by reference herein in its entirety.

What is claimed is:

1. An electrophotographic photosensitive member comprising a cylindrical support, an undercoat layer and a photosensitive layer in this order, a surface of the support comprising a line-shaped groove in a circumferential direction of the support, wherein 50 μm≤a≤500 μm when a represents a length of the line-shaped groove in the circumferential direction, with regard to 90% or more of the line-shaped groove based on the entirety thereof, $$0.7\ \mu m \leq Rzjis$$

$$Rsm \leq 50\ \mu m, \text{ and}$$

$$-4.0 \leq Rsk \leq -0.2$$

where Rzjis is a ten-point average roughness, Rsm is an average length of a roughness profile element and Rsk is a skewness according to JIS B 0601:2001 obtained from a roughness profile in an axial direction of the surface of the support.

2. The electrophotographic photosensitive member according to claim 1, wherein −1.2≤Rsk≤−0.2.

3. The electrophotographic photosensitive member according to claim 1, wherein $$50\ \mu m \leq a \leq 400\ \mu m,$$

$$1.0\ \mu m \leq Rzji \leq 1.5\ \mu m \text{ and}$$

$$30\ \mu m \leq Rsm \leq 40\ \mu m.$$

4. A process cartridge supporting an electrophotographic photosensitive member comprising a cylindrical support, an undercoat layer and a photosensitive layer in this order and at least one unit selected from the group consisting of a charging unit, a developing unit, a transfer unit and a cleaning unit, and being detachably attachable to a body of an electrophotographic apparatus, a surface of the support of the electrophotographic photosensitive member comprises a line-shaped groove in a circumferential direction of the support, wherein 50 μm≤a≤500 μm when a represents a length of the line-shaped groove in the circumferential direction, with regard to 90% or more of the line-shaped groove based on the entirety thereof, $$0.7\ \mu m \leq Rzjis$$

$$Rsm \leq 50\ \mu m, \text{ and}$$

$$-4.0 \leq Rsk \leq -0.2$$

where Rzjis is a ten-point average roughness, Rsm is an average length of a roughness profile element and Rsk is a skewness according to JIS B 0601:2001 obtained from a roughness profile in an axial direction of the surface of the support.

5. An electrophotographic apparatus comprising an electrophotographic photosensitive member comprising a cylindrical support, an undercoat layer and a photosensitive layer in this order, a charging unit, an exposure unit, a developing unit and a transfer unit, a surface of the support of the electrophotographic photosensitive member comprising a line-shaped groove in a circumferential direction of the support, wherein 50 μm≤a≤500 μm when a represents a length of the line-shaped groove in the circumferential direction, with regard to 90% or more of the line-shaped groove based on the entirety thereof, $$0.7\ \mu m \leq Rzjis$$

$$Rsm \leq 50\ \mu m, \text{ and}$$

$$-4.0 \leq Rsk \leq -0.2$$

where Rzjis is a ten-point average roughness, Rsm is an average length of a roughness profile element and Rsk is a skewness according to JIS B 0601:2001 obtained from a roughness profile in an axial direction of the surface of the support.

6. The electrophotographic apparatus according to claim 5, wherein the charging units comprise a charging roller disposed so as to abut the electrophotographic photosensitive member, and a charging unit for charging the electrophotographic photosensitive member by applying direct current voltage only.

* * * * *